United States Patent [19]

Wardell, Jr. et al.

[11] 4,076,366

[45] Feb. 28, 1978

[54] HIGH VOLTAGE ELECTRON TUBE BASE WITH SEPARATE DIELECTRIC FILL-HOLE

[75] Inventors: Myron Henry Wardell, Jr., Lititz; Bruce George Marks, Lancaster, both of Pa.

[73] Assignee: RCA Corporation, New York, N.Y.

[21] Appl. No.: 798,127

[22] Filed: May 18, 1977

[51] Int. Cl.[2] ..... H01R 13/46

[52] U.S. Cl. ..... 339/144 T; 313/318

[58] Field of Search ..... 339/143 R, 143 T, 144 R, 339/144 T, 145 T, 275 B; 313/318, 57, 477, 482

[56] References Cited

U.S. PATENT DOCUMENTS

| | | | |
|---|---|---|---|
| 3,278,886 | 10/1966 | Blumemberg et al. | 339/145 T |
| 4,040,707 | 8/1977 | Pisano | 339/143 T |
| 4,040,708 | 8/1977 | Neuber et al. | 339/143 T |

*Primary Examiner*—Roy Lake

*Assistant Examiner*—E. F. Desmond

*Attorney, Agent, or Firm*—E. M. Whitacre; G. H. Bruestle

[57] ABSTRACT

The base comprises a tubular housing adapted to fit over the exhaust tubulation of an electron tube stem, and a wafer flange extending outwardly from the open end thereof. The flange is apertured to receive an array of conductors of the stem. A recess is provided in the wafer flange facing the stem and a passageway communicating therewith is provided through the base separate from the housing cavity for the purpose of injecting a dielectric material into the recess around some of the stem conductors. The passageway may, e.g., be through the flange or in the housing wall.

A shoulder is provided on the recessed face of the wafer flange to provide relief for random protuberances on the periphery of the stem to permit non-tilted mounting of the base on the stem.

9 Claims, 12 Drawing Figures

Fig. 8.
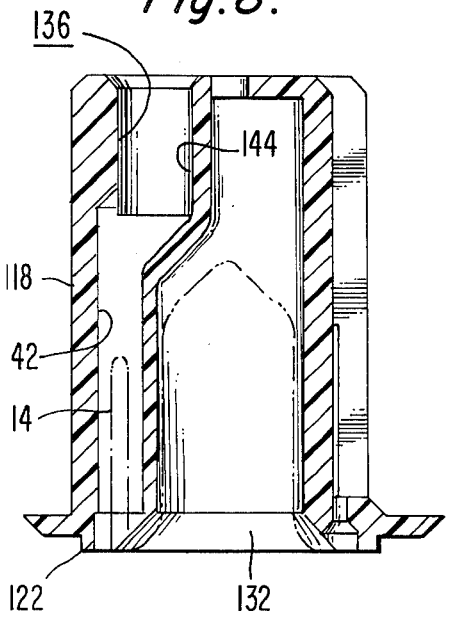
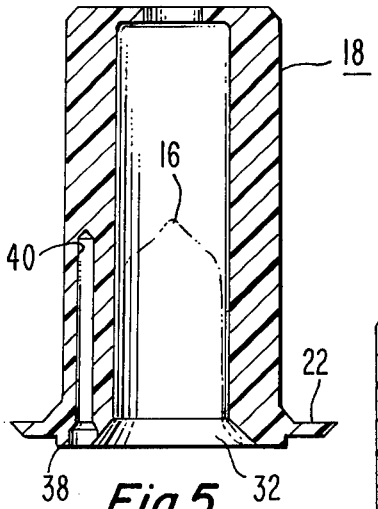
Fig. 5.
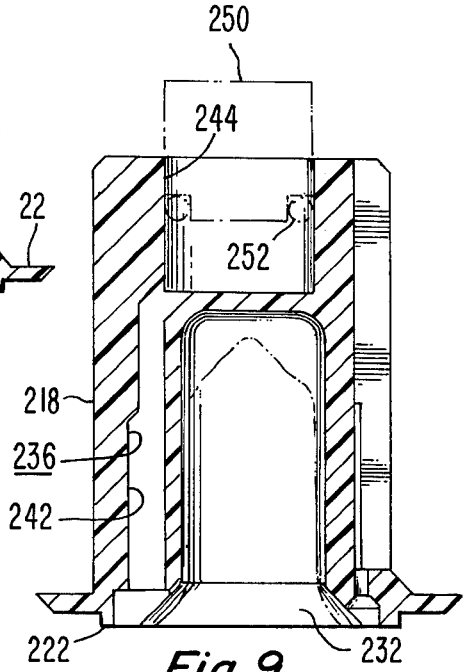
Fig. 9.
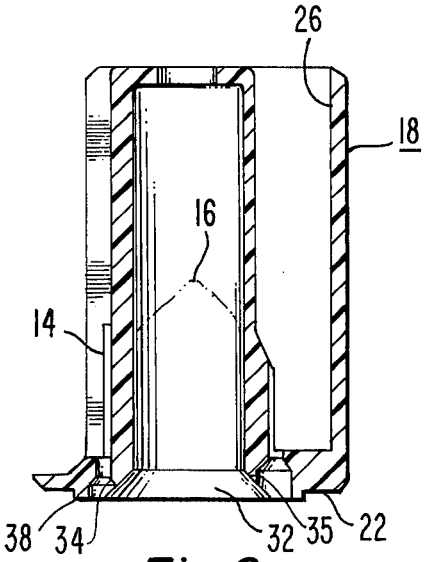
Fig. 6.
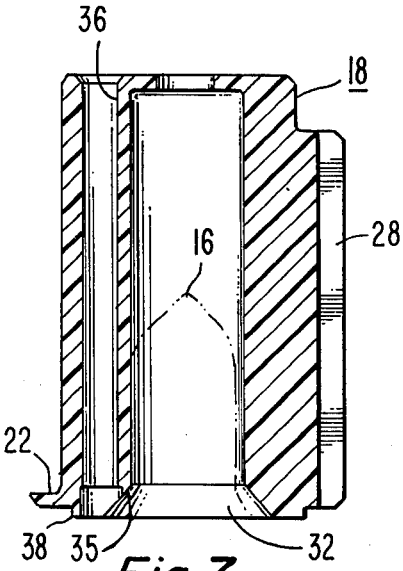
Fig. 7.

HIGH VOLTAGE ELECTRON TUBE BASE WITH SEPARATE DIELECTRIC FILL-HOLE

This invention relates to electron tube bases and particularly to those of the wafer type which include a body of dielectric material molded therein for the purpose of increasing the voltage breakdown between the lead-in conductors of the base.

BACKGROUND OF THE INVENTION

One type of electron gun recently proposed for color picture tubes is described in U.S. Pat. No. 3,995,194, issued to Blacker et al. This gun includes an electrode to which an operating voltage of approximately 12 kilovolts is applied. In the manufacture of tubes incorporating such guns, it is often desired to apply a "spot-knocking" voltage of approximately 30 kilovolts to this electrode in order to remove sharp points and particles therefrom which might otherwise later cause harmful arcing during tube operation. This spot-knocking voltage must be brought in through the base and stem of the tube, and severe voltage breakdown problems are encountered when conventional prior art bases are used.

U.S. Pat. No. 3,278,886 to Blumemberg et al discloses a type of wafer base in which a housing is disposed over the exhaust tubulation of an electron tube stem and the stem's lead-in are disposed through apertures in a wafer flange extending from the housing. U.S. Pat. No. 3,979,157 to Dimattio discloses a modification of this type of wafer base in which the lead-ins are disposed in grooves in the housing wall of the base and lie against the floor of the grooves.

The Blumemberg et al base is especially designed for high voltage applications. To this end it incorporates a tubular silo structure which surrounds one of the lead-ins to which high voltage is applied, and a recess in the base into which a dielectric material is molded around the lead-ins. Both of these features serve to increase resistance against high voltage breakdown.

In mounting a base of the Blumemberg et al type to an electron tube stem, it has been the practice heretofore to simply insert a quantity of plastic dielectric material into the recess of the base and then apply the base to the stem. Since the dielectric material is applied to the base while it is out of contact with the stem, the result is a messy process. Alternatively, the plastic dielectric material may be injected through the exhaust tubulation housing. When the latter is done, sufficient material must be injected to completely fill the housing in order that some of the dielectric material is forced into the recess in the bottom of the base. The difficulty with this procedure is that exhaust tubulations are not of uniform volume from tube to tube, and hence the amount of dielectric material which must be injected varies from tube to tube. This prevents the injection of a specific amount of material and thus complicates the injection process.

Prior art bases such as the Blumemberg et al base experience another problem when they are used with neck-stem structures as conventionally fabricated in the color picture tube industry. In fabricating the neck-stem structure of a picture tube envelope, the neck is heated to soften the glass and fuse it to the stem. The heating is continued until a short length of neck section extending beyond the stem is completely severed from the remainder of the neck and drops free therefrom. When this short piece of neck section separates from the rest of the neck, it causes a drip or slight protuberance in the glass to form at one point around the periphery of the stem. When prior art bases have been applied to stems having drips of this type, the base is caused to tilt relative to the longitudinal axis of the tube. Such tilt, in addition to being aesthetically undesirable, often creates problems in inserting the base into its mating socket. Furthermore, the gap between the base and stem due to the tilting frequency allows the dielectric material injected into the base to flow therefrom leaving a deficiency of material to provide the desired dielectric body for high voltage breakdown insulation.

SUMMARY OF THE INVENTION

A wafer type electron tube base having an exhaust tubulation housing is provided with a dielectric receiving recess in the wafer thereof. A passageway in the base communicating with the recess is provided as a fill-hole for the plastic dielectric material. The passageway is separate and apart from the cavity of the tubulation housing cavity.

BRIEF DESCRIPTION OF THE DRAWINGS

FIGS. 4, 5, 6 and 7 are sections taken through the tube base of FIGS. 1, 2 and 3 along the lines 4—4, 5—5, 6—6, and 7—7, respectively of FIG. 2.

FIGS. 8 and 9 are enlarged longitudinal section views of modifications of the base of FIGS. 1–7.

DESCRIPTION OF PREFERRED EMBODIMENTS

Figure 1:
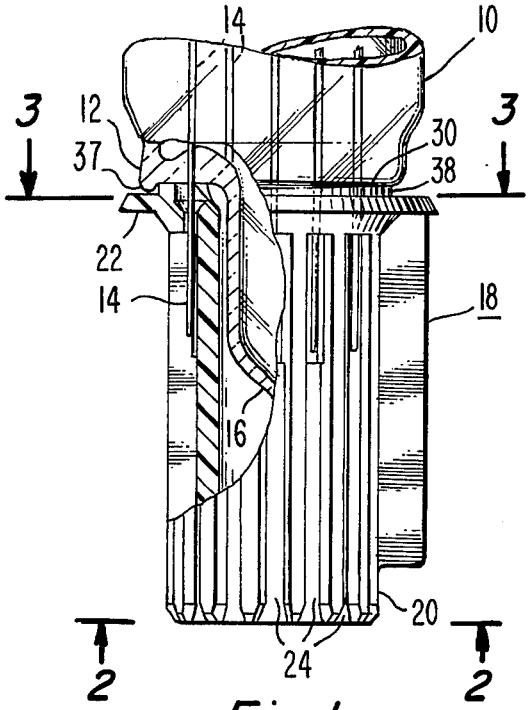
FIG. 1 is a side elevation view with parts broken away of the novel tube base disposed in mating relation with a cathode ray tube, only the stem and adjacent neck portion of which are shown.

Referring to FIGS. 1–7, a glass neck portion 10 of a color picture tube is closed at one end with a glass stem 12 which includes an array of stiff conductors 14. The conductors 14 are sealed through the stem 12 and extend therefrom in a circular array parallel to each other. The stem 12 also includes a closed off exhaust tubulation 16 disposed centrally within the circular array of conductors or leads 14. A base member 18 is attached to the end of the stem 12.

The base member 18 of the wafer type and comprises a cylindrical housing 20 having an opening 21 at one end and a wafer flange 22 which extends radially outwardly therefrom. The cylindrical housing 20 is hollow and fits loosely over the exhaust tubulation 16. The outer cylindrical surface of the housing 20 is provided with a series of longitudinal grooves 24 which extend from the wafer flange 22 to the opposite distal end of the housing 20. The wafer flange 22 is provided with a circular array of apertures 25 therethrough. The circular array of conductors 14 are disposed through the array of apertures 25 and lie one in each of the grooves 24.

The base 18 is also provided with a tubular chamber or silo 26 (FIGS. 2 and 6) disposed coextensively along side the housing 20. The silo 26 is closed at one end by the wafer flange 22 and is open at the opposite end. The silo 26 receives therein one of the leads 14 which is intended to have a high spot-knocking voltage applied thereto. The silo 26 serves to provide a greatly increased discharge path from the high voltage lead contained therein to any one of the adjacent leads.

Also provided to increase voltage breakdown between the leads is a radially extending fin 28 disposed between two adjacent leads 14. The fin 28, while not as effective as the silo 26 is preventing high voltage breakdown, is nevertheless adequate for the lesser voltages to be applied to the leads 14 on the opposite sides thereof.

The stem-contacting face 30 of the wafer flange 22 is provided with a recess 32. The depth of the recess 32 is not critical. It need be only deep enough to allow a thin layer of dielectric material molded therein to form a continuous body that will contact selected ones of the leads 14 at their interface with the glass body of the stem 12. Typically, a depth of about 2.5 mm has been found to be satisfactory. The recess 32 has a lateral dimension sufficient to completely encompass the high voltage lead 14 in the silo 26 and the adjacent lead 14 disposed between the silo 26 and the fin 28. The recess 32 is generally defined by a arcuate boundary which passes through the centers of the rest of the leads 14. However, fillet-like cavities 34 provided at each of the other leads 14 allow dielectric material injected into the recess 32 to also surround those leads as well where they enter the stem 12.

In actual practice not all leads will have high voltages applied to them and hence need not be surrounded by the dielectric material. To this end, in a preferred practice with the base 18, the dielectric material is forced into the recess 32 until it encompasses the high voltage lead 14 in the silo 26 and the lead 14 between the silo 26 and the fin 28, and spreads further across the recess 32 until about half of the lateral dimension of the recess is filled.

In order to access the recess 32 for the purpose of injecting plastic dielectric material thereinto, a passageway or fill-hole 36 (FIGS. 2, 3, and 6) is provided in the base 18, preferably in a wall of the housing 20, and extends from the distal end thereof to the opposite end of the base 18 where it communicates with the recess 32. Dielectric material can be dispensed through the fill-hole 36 simply by positioning a dispenser nozzle at the distal end thereof. Since the fill-hole 36 has a uniform volume from base to base, a specific metered amount of dielectric material can be dispensed thereinto such that it will fill the fill-hole 36 and enter the recess 32 with a slight overflow into the housing 20 around the exhaust tubulation 16. Thus, regardless of the volume of the exhaust tubulation 16, the recess 32 can be filled without fear of overflow out of the base 18 thereby causing messy spillage.

In order to insure a complete filling of that portion of the recess 32 in the region of the silo lead 14, the recess is divided into two sections. A first section **32*a* is arcuate in shape and encompasses the fill-hole 36, the silo lead 14, and the adjacent lead 14 between the silo 26 and fin 28. A second section 32*b* is constituted by the remainder of the recess 32. The first section 32*a* is partially separated from the second section 32*b* by a lip 35 (FIGS. 3, 4, 6 and 7). Thus, when dielectric material is injected into the recess 32 from the fill-hole 36, it enters the first section 32*a* and substantially fills it before it spills over the lip 35 into the second section 32*b*. This insures a thorough encompassing of the two leads 14 in the first section 32*a*** where high voltage breakdown insulation is more important.

In the embodiment of the base of FIGS. 1–7, the fill-hole 36 is shown in its simpliest form as a straight cylindrical bore. However, other forms of the fill-hole, wherein the passageway thereby provided may be bent, may be provided as alternatives. For example, in FIG. 8 a base 118 is provided with a fill-hole 136 which includes a first portion 142 communicating with a recess 132 in the wafer flange portion 122 of the base 118, and a second portion 144 which is offset toward the central axis of the base 118 and is somewhat enlarged relative to the first portion 142. The offset is preferred so that when a dielectric injection nozzel is pressed against the opening in the fill-hole 136, the force applied to the base 118 will be more nearly axial and thus less likely to cause tilting of the base on the stem 12. The enlargement of the second portion 144 allows easier injection of the dielectric material into the fill-hole 136.

In FIG. 9, another embodiment of fill-hole is shown. A base 218 includes a fill-hole 236 comprising a first portion 242 communicating with a recess 232 in the wafer flange portion 222 of the base 218, and a second portion 244 offset therefrom and disposed nearly coaxially of the base 218. The second portion 244 is extremely enlarged relative to the first portion 242, similar to that provided in the fill-hole 136 shown in FIG. 8.

Also shown in FIG. 9 is a piston 250 preferably having a rubber O-ring 252 at one end thereof. The piston 250 is adapted to be received snuggly within the second portion 244 of the fill-hole 236. Thus, a charge of dielectric material can be disposed in the second portion 244 and then the piston 250 advanced thereinto to force dielectric material into the first portion 242 and into the recess 232 of the base 218.

Referring again to FIG. 1, the stem 12 includes a glass drip 37 at the periphery of the stem 12 which extends a short distance beyond the otherwise even periphery of the stem. The drip results from the conventional procedure employed in fabricating neck-stem structures as described hereinabove. The novel base 18 is provided with drip relief means which allows the base to be seated axially aligned with its tube. This means is provided in the form of an annular shoulder 38. The shoulder 38 allows the drip 37 to be received radially outwardly from the shoulder into a recessed portion of the wafer flange 22.

The drip relief means may be thought of simply as the removal of an annular peripheral portion of the wafer flange 22 to produce the shoulder 38, or as an annular ridge disposed on the end surface of the wafer flange 22 having the shoulder 38 as one side surface thereof. Experience has shown that in conventional procedures used to seal a stem 12 to the neck section of a picture tube, the largest drips 37 which are normally produced can be relieved by a shoulder 38 which is approximately 0.75 mm high.

To better insure that the dielectric material thoroughly surrounds the silo lead 14, a portion of the drip relief ridge 38 can be either cut away adjacent to the silo lead 14, or it can be displaced away from the lead.

Figure 10:
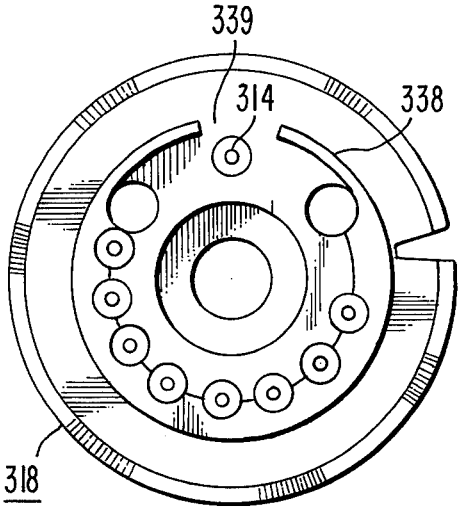
FIGS. 10 and 11 are plan views similar to that of FIG. 3 of modifications of the base of FIGS. 1–7.

FIG. 10 illustrates a base 318 which differs from the base 18 in that it has a discontinuous drip relief ridge 338 with a portion thereof cut away adjacent to the silo lead 314. This produces a gap 339 which allows the dielectric material to better flow around the silo lead 314.

Alternatively, the ridge may be made discontinuous in a number of places so that it contacts the stem 12 with a plurality of short sections, which function somewhat in the nature of a plurality of feet on the base which abut the stem 12. The preferred embodiment of the ridge shoulder is that it be as fully continuous as possible and still allow adequate insulation around the high voltage lead. When the ridge shoulder is completely continuous, it serves the additional function of providing a dam or seal wall for the plastic dielectric material which is injected into the recess. This allows the production of a neater, cleaner product.

Figure 11:
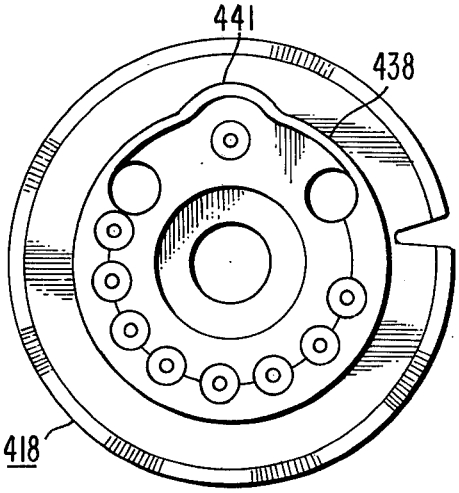

FIG. 11 illustrates a base 418 which differs from the base 18 in that it has a drip relief ridge 438 which includes a sharp arcuate section 441 adjacent to the silo lead 414. The arcuate section 441 is displaced away from the silo lead 414 more than the drip relief ridge 38 of the base 18 so that the dielectric material can better flow around the silo lead 414.

Figure 12:
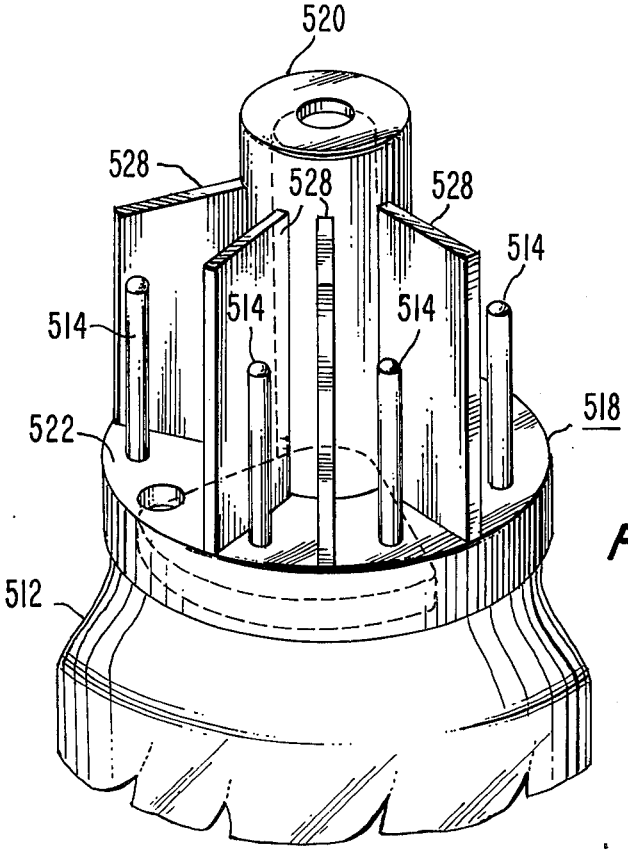
FIG. 12 is a perspective view of another embodiment of the novel tube base.

FIG. 12 illustrates a base 518 useful in applications with less severe high voltage breakdown problems. The base 518 is of the wafer type with a tubulation housing 520 and a wafer flange 522 at the open end of the housing. An array of leads 514 from a stem structure 512 are received through an array of apertures in the wafer flange 522, and are free standing. The flange 522 is provided with a recess 532 in the face thereof adapted to abut the stem 512. At least one of the leads 514 passes through the wafer flange 522 within the recess 532. A dielectric fill-hole 536 is provided through the wafer flange 522 and opens into the recess 532 for injecting dielectric material into the recess around the leads therein. Optionally, one or more fins 528 may be provided along the housing 520 between adjacent leads 514 to improve high voltage breakdown.

Figure 2:
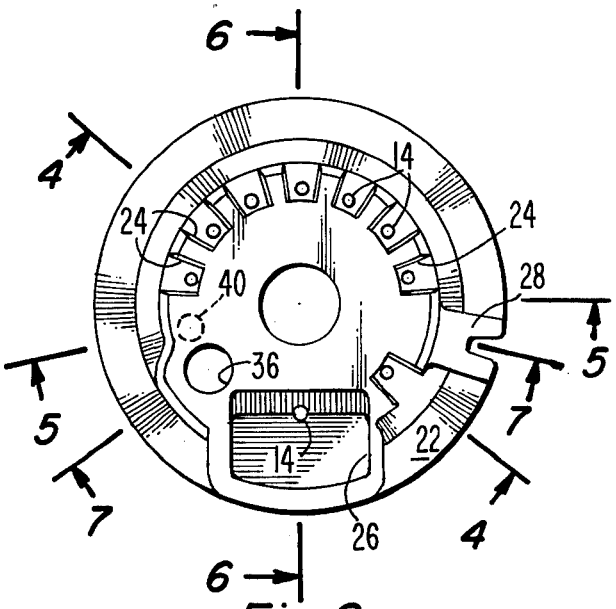
FIG. 2 is an enlarged bottom plane view of the tube base of FIG. 1 taken along the line 2—2 thereof.
Figure 3:
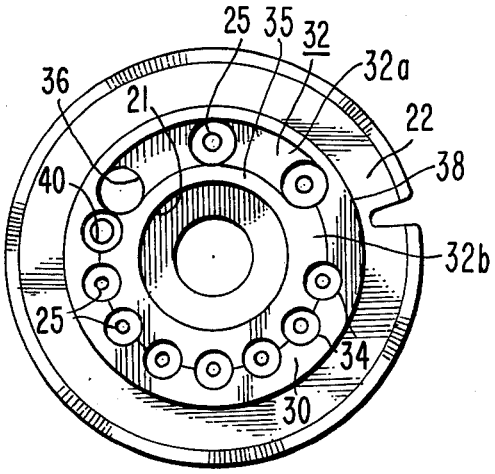
FIG. 3 is an enlarged top plan view of the electron tube base of FIG. 1 taken along the line 3—3 thereof.
Figure 4:
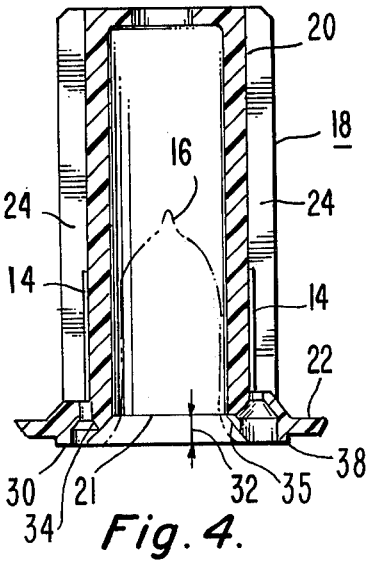

As shown in FIGS. 2, 3 and 5, a blind bore 40 is provided in the housing 20 at one of the lead locations such that a lead 14 from the stem 12 can be received therein. No external contact is accessible to this lead from the base 18. The purpose of this structure is to permit use of a universal type stem 12 having a fixed number of leads 14 even though some of them will not actually be used to make contact with any electrodes inside the picture tube itself. Whereas only one such bore 40 is shown in the drawings, additional blind bores may be provided at other lead locations.

A lead 14 may also be disposed in the fill-hole 36. To this end, the fill-hole 36 is located at one of the regular lead locations in the circular arrays of leads 14.

Materials suitable for use as the dielectric are those which can be injected in liquid form and then hardened to produce a good dielectric insulator body. The silicone rubbers are useful in this respect but suffer from the disadvantage of requiring a rather lengthy curing time which causes a slow down on the production line. Preferred materials are the hot melt polyamide resins which are thermoplastic. One such resin found to have acceptable dielectric properties is that sold by General Mills under the trade name Versalon 1138.

Materials suitable for the base itself are hard strong ones which have good dielectric properties and can be easily molded to the desired shape. Such materials include glass filled plastic resins. A preferred material is one sold under the trade name of Celanex 3310 by Celanese Plastics Company.

What is claimed is:

1. A base member adapted to be disposed over an array of lead conductors and an exhaust tubulation of an electron tube, said base member comprising:

a. a tubular housing having an open end for receiving said exhaust tubulation therein, b. a flange extending outwardly from said housing at said open end thereof, c. an array of apertures through said flange for receiving said array of conductors therethrough, d. a recess in said flange encompassing said open end and at least one of said apertures, and e. a passageway in said base member separate from the tubulation receiving cavity of said housing and opening into said recess.

2. The base member of claim 1 wherein said passageway is through said flange.

3. The base member of claim 1 wherein said passageway is in the wall of said tubular housing.

4. The base member of claim 3 wherein said passageway extends longitudinally along said tubular housing wall from one end thereof to the other.

5. The base member of claim 4 wherein said passageway has a bend therein so that the opening of said passageway at the distal end of said tubular housing is offset toward the longitudinal axis of said tubular housing.

6. The base member of claim 4 further comprising a piston within said passageway for forcing material through said passageway and into said recess.

7. The base member of claim 3 wherein said wall of said housing is longitudinally grooved with the grooves being adapted to receive said conductors in the bottoms thereof.

8. The base member of claim 3 further comprising a tubular silo disposed alongside said tubular housing wall and closed at one end by said flange and open at the opposite end thereof for receiving one of said conductors therein.

9. The base member of claim 1 wherein said recess comprises two sections partially separated by a lip, whereby material injected from said passageway into one of said sections will substantially fill that section and then spill over said lip into the other of said sections.

* * * * *